US006338407B2

(12) United States Patent
Danville

(10) Patent No.: US 6,338,407 B2
(45) Date of Patent: Jan. 15, 2002

(54) CHILD RESISTANT MEDICATION PACKAGE

(75) Inventor: David Roy Danville, Millburn, NJ (US)

(73) Assignee: Novartis Pharmaceuticals Corp., East Hanover, NJ (US)

( * ) Notice: Subject to any disclaimer, the term of this patent is extended or adjusted under 35 U.S.C. 154(b) by 0 days.

(21) Appl. No.: 09/805,075

(22) Filed: Mar. 13, 2001

Related U.S. Application Data

(63) Continuation of application No. 09/177,477, filed on Oct. 22, 1998, now Pat. No. 6,230,894.

(51) Int. Cl.[7] ..... B65D 83/04

(52) U.S. Cl. ..... 206/532; 206/469; 206/484; 206/538

(58) Field of Search ..... 206/469, 484, 206/532, 538, 539; 383/200, 207, 209

(56) References Cited

U.S. PATENT DOCUMENTS

| | | | | | |
|---|---|---|---|---|---|
| 3,809,220 | A | * | 5/1974 | Arcudi | 206/484 |
| 3,811,564 | A | * | 5/1974 | Braber | 206/469 |
| 3,835,995 | A | * | 9/1974 | Haines | 206/484 |
| 4,011,949 | A | * | 3/1977 | Braber et al. | 206/532 |
| 4,243,144 | A | * | 1/1981 | Margulies | 206/532 |
| 4,294,361 | A | * | 10/1981 | Margulies et al. | 206/532 |
| 4,398,634 | A | * | 8/1983 | McClosky | 206/532 |
| 5,046,618 | A | * | 9/1991 | Wood | 206/532 |
| 5,088,603 | A | * | 2/1992 | Kirkpatrick | 206/532 |
| 5,325,968 | A | * | 7/1994 | Sowden | 206/532 |
| 5,511,665 | A | * | 4/1996 | Dressel et al. | 206/532 |
| 5,551,567 | A | * | 9/1996 | Malone et al. | 206/469 |
| 5,862,915 | A | * | 1/1999 | Plezia et al. | 206/532 |
| 5,878,888 | A | * | 3/1999 | Faughey et al. | 206/532 |
| 5,894,930 | A | * | 4/1999 | Faughey et al. | 206/532 |

FOREIGN PATENT DOCUMENTS

| | | | |
|---|---|---|---|
| EP | 0634342 | A2 * | 1/1995 |
| WO | 9603329 | A1 * | 2/1996 |

* cited by examiner

*Primary Examiner*—Bryon P. Gehman
(74) *Attorney, Agent, or Firm*—John D. Thallemer

(57) ABSTRACT

A child-resistant, adult friendly package is disclosed. The package is designed to require a sequence of opening steps too complex for a child to perform, but simple enough for an adult to perform. The package is formed from a top having a surface that projects from one face of the top sheet and forms a recess in the opposite face of the top sheet, a bottom sheet overlying the opposite face of the top sheet, arranged to enclose the recess, a sealed portion and an unsealed portion formed between the top sheet and the bottom sheet, wherein each recess is associated with a sealed portion and an unsealed portion, and a tear slit located between the unsealed portion and an edge of the package, wherein the tear slit does not contact any edge of the package.

6 Claims, 3 Drawing Sheets

CHILD RESISTANT MEDICATION PACKAGE

This is a continuation of application Ser. No. 09/177,477, filed Oct. 22, 1998, now U.S. Pat. No. 6,230,894.

FIELD OF THE INVENTION

The subject invention relates to a package used to hold medication in a child resistant manner. More specifically, the invention relates to a blister package that, while remaining child resistant, may be easily opened by adults and senior citizens. The invention also relates to a method for dispensing medication from the package.

BACKGROUND OF THE INVENTION

The packaging industry offers a wide array of packages or dispensers to safely contain potentially hazardous materials. For example, manufacturers have typically designed such packages to hold medication dosages in a child resistant manner. By their child resistant design, the packages lessen the chances that a child will gain access to the medication and therefore prevent the occurrence of an overdose.

A problem has occurred with child resistant packages, however, in that the packages have sometimes prevented the intended recipient of the medication from accessing the medication. Depending on the difficulty of the step or steps needed to open the package, certain adults may find it inconvenient or even nearly impossible to access the medication. The difficulty in opening the packages can be further aggravated for senior citizens and persons having infirmities or physical weaknesses that affect their motor skills. At best, conventional child resistant packages may present an inconvenience. At worst, conventional child resistant packages may discourage and/or prevent the intended recipient of the medication from taking the prescribed dosages. Clearly, a need exists for improved packages that are child resistant but remain reasonably accessible for adults to open.

U.S. Pat. No. 5,046,618 relates to a child resistant blister package that is opened by a sequence of actions. First, a tear is made in a first direction running in between the blister packs. A second tear is made perpendicular to the first tear, also in a direction running in between the blister packs. The second tear intersects the first tear and isolates a single blister pack. A third tear is made, again in a direction that does not lead directly to the blister pack. The third tear exposes an unsealed area at a corner of the isolated blister pack, thereby allowing a bottom packaging layer to be peeled from an upper layer to expose the medication in the blister pack.

U.S. Pat. No. 5,088,603 also relates to a child resistant package. In the '603 patent, individual blister packs are separated from one another by perforation lines. For each blister pack, a tear slit is located to bisect the longitudinal axis of each blister and to extend less than one third of the distance between a perforation edge and the blister. Thus, the tear slit allows the user to tear the package in the direction of the blister.

SUMMARY OF THE INVENTION

An object of the present invention is to provide a package that is child resistant.

Another object of the present invention is to provide a package that is accessible to senior citizens.

Another object of the present invention is to provide a package that requires more than one step to access medication contained therein.

To achieve these and other objects and in accordance with the purpose of the present invention, as embodied and broadly described herein, the present invention relates to a package formed by a top sheet having a surface that projects from one face of the top sheet and forms a recess in the opposite face of the top sheet; a bottom sheet overlying said opposite face of the top sheet, arranged to enclose the recess; a sealed portion and an unsealed portion formed between the top sheet and the bottom sheet, wherein each recess is associated with a sealed portion and an unsealed portion; and a tear slit located between the unsealed portion and an edge of the package, wherein the tear slit does not contact any edge of the package.

The present invention also relates to a method of dispensing medication contained in a recess of the package, wherein the method includes folding the package to form a folded edge exposing the tear slit at the folded edge; initiating a tear at the exposed tear slit and continuing the tear to intersect the unsealed area; peeling either the top sheet or the bottom sheet to expose the medication contained in the recess of the separated unit; and dispensing the medication from the package.

The present invention also relates to a method of dispensing medication contained in a recess of a package, wherein the package has a top sheet having a surface that projects from one face of the top sheet and forms a recess in the opposite face of the top sheet, a bottom sheet overlying said opposite face of the top sheet, arranged to enclose the recess, and a tear slit located between the unsealed portion and an edge of the package, wherein the tear slit does not contact any edge of the package; and the method includes folding the package to form a folded edge exposing the tear slit at the folded edge, initiating a tear at the exposed tear slit and continuing the tear to intersect the recess and provide access to the medication, and dispensing the medication from the package.

DETAILED DESCRIPTION OF THE PREFERRED EMBODIMENTS

The package described herein advantageously requires, in order to open that package, several sequential steps. In one embodiment, the package comprises a top sheet having a surface that projects from one face of the top sheet and forms a recess in the opposite face of the top sheet, a bottom sheet overlying said opposite face of the top sheet and enclosing the recess, a sealed portion and an unsealed portion formed between the top sheet and the bottom sheet, wherein each recess is associated with a sealed portion and an unsealed portion.

As used herein, the term "recess" embraces the area of the package intended to hold the medication.

The bottom sheet of the package may typically be flat, or it may also have a surface projecting from one face to form a recess in the opposite face of the bottom sheet. Such a recess in the bottom sheet, also known as the lidding sheet, would typically be aligned with the recess in the top sheet to provide additional space for the medication to be held.

The package also includes a tear slit extending between the unsealed portion and an edge of the package, wherein the tear slit does not contact any edge of the package. Preferably, the tear slit extends in a direction away from the recess and towards the unsealed portion. In a preferred embodiment, the package comprises a plurality of recesses or blisters substantially arranged in rows, with a first line of weakness and a second line of weakness in the top sheet and/or bottom sheet, wherein said first and second lines extend substantially between opposite edges of the package and substantially between the rows of blisters. In that preferred embodiment, the tear slit does not contact any edge of the package and does not contact either the first or second line of weakness.

Figure 1:
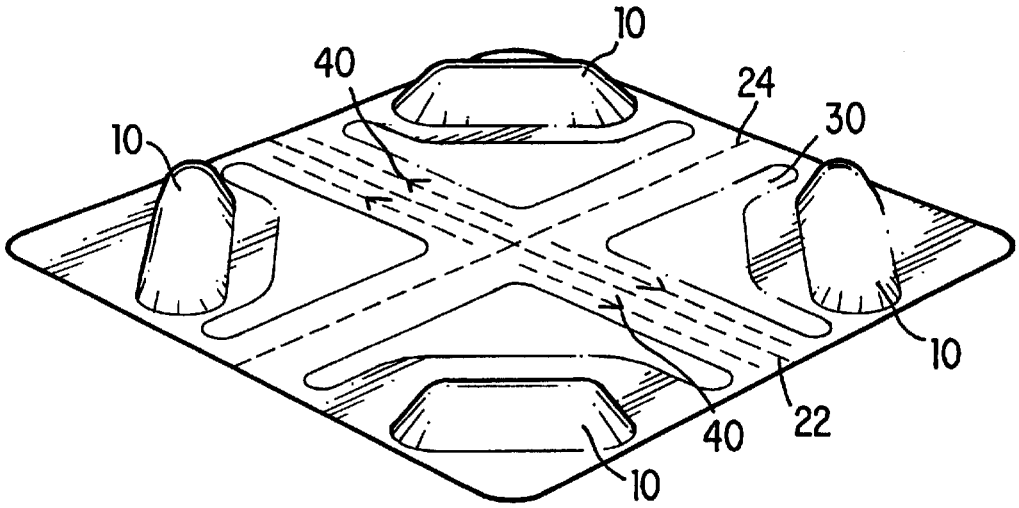
FIG. 1 shows a package having a plurality of blisters arranged in rows.

Referring now to the figures, which depict preferred embodiments of the claimed invention, FIG. 1 shows a blister package having four blisters 10 arranged substantially in rows. In between the rows, a first line of weakness 22 and a second line of weakness 24 extend substantially between opposite edges of the blister package, separating the rows. Each blister of the blister package is also located in proximity to an unsealed area 30 and a preferred third line of weakness 26. The third line of weakness 26 may run in a direction substantially parallel to either the first or second line of weakness, or substantially parallel to an edge of the blister package. As shown in FIG. 1, in a preferred embodiment the third line of weakness is located between either the first or second lines of weakness and the unsealed area 30 and is spaced apart from each.

The package also contains a tear slit 40 that is spaced apart from and does not contact any edge of the package. Tear slit 40 is also spaced apart from and does not contact either the first line of weakness 22 or the second line of weakness 24. Preferably, tear slit 40 is located so that the package cannot be opened by initiating a tear at an edge and through the slit, without applying a substantial tearing force. Instead, the slit 40 is located so that the user must fold the package to create an edge at the fold line and expose the slit 40. Once slit 40 is exposed at an edge, the user may then initiate a tear at the slit in a direction towards the unsealed area 30.

The tear slit may have any shape and may be arranged in any direction, although a slit arranged so that it leads in the direction of unsealed area 30 is preferred. In a preferred embodiment, the tear slit forms an angle or is V-shaped. When the package is folded, the resulting fold line defines an edge that intersects the tear slit. Preferably, the fold line intersects the tear slit at the vertex of any angle formed by the tear slit.

Figure 4:
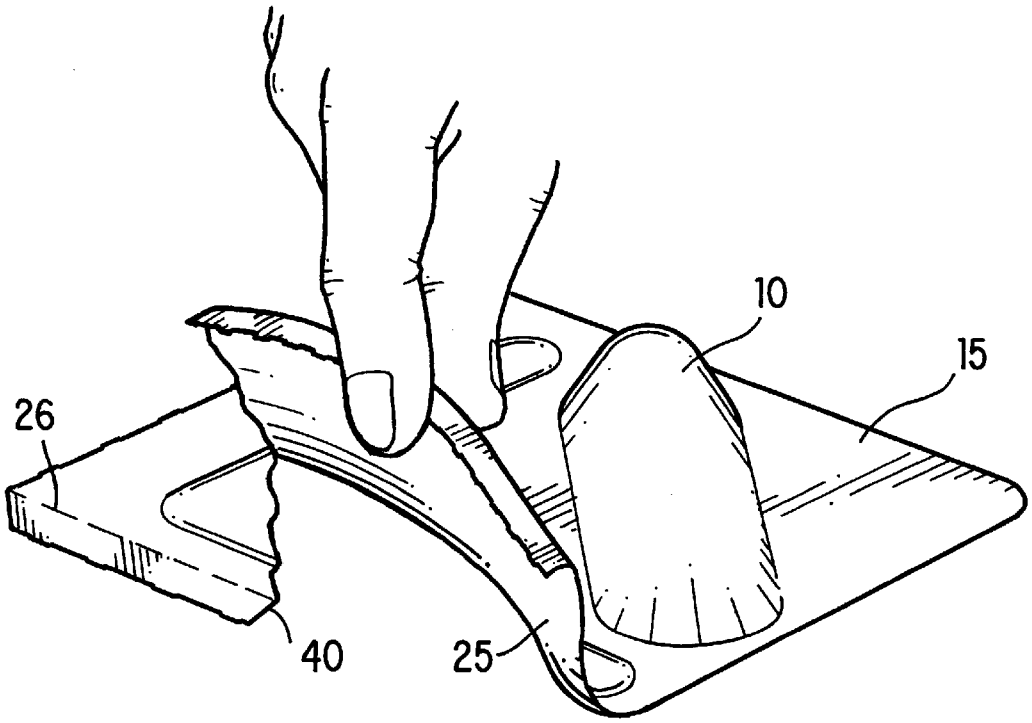
FIG. 4 shows the step of initiating a tear and propagating the tear in a direction substantially parallel to the blister towards an unsealed area of the package.

Once the package is folded to form an edge exposing the tear slit, a tear is initiated through the tear slit. Generally, the direction and arrangement of the tear slit influences the direction of the tear. As shown in FIG. 4, tear 50 is initiated through a folded or double layer of the blister package material. In other words, because the tear slit is exposed at an edge by first folding the top sheet 15 and the bottom sheet 25, tear 50 at tear slit 40 is actually initiated through two layers of the top sheet and two layers of the bottom sheet. In such an embodiment, the tear slit should be designed so that the intended user may tear the folded package material without too much difficulty. To this end, the distance from the slit to the edge of the package should be reduced to reduce the distance that the tear 50 must propagate through folded package material. At the same time, however, the distance from the slit to the edge of the package should not be so small that children may initiate a tear at an edge of the package without the folding step.

Figure 3:
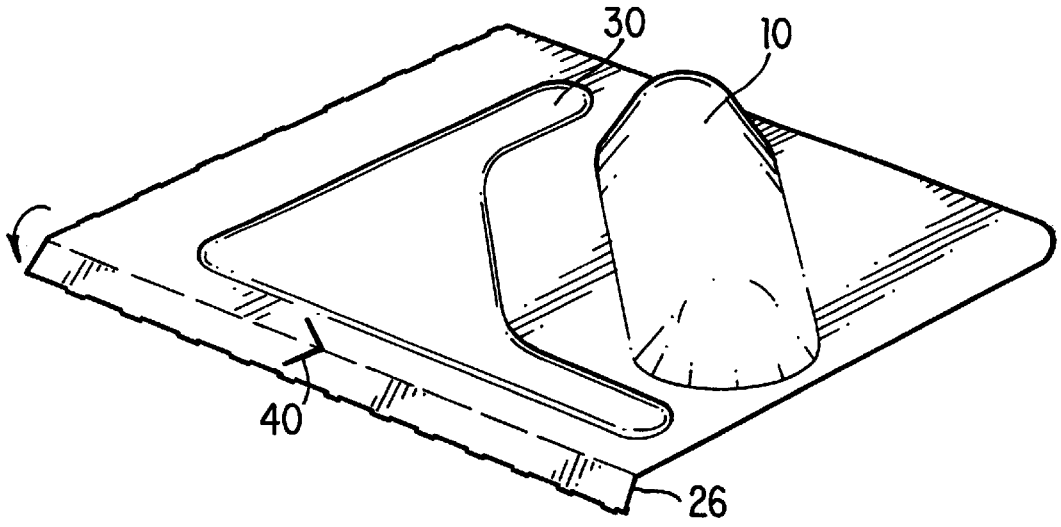
FIG. 3 shows the step of folding along a third line of weakness to expose a notch.

In a preferred embodiment, the tear slit crosses the third line of weakness 26. In that embodiment, the user folds the package along the third line of weakness 26 to form an edge exposing tear slit 40, as shown in FIG. 3. Preferably, as also shown in FIG. 3, the tear slit 40 intersects a perforation in third line of weakness 26. Thus, tear slit 40 forms an angle bisected by the third line of weakness into two, not necessarily equal parts.

The term "tear slit" is used herein for convenience only. As used herein, the term "tear slit" means any weakness in the package material through which a tear may be initiated. Examples of such a weakness include, but are not limited to, partial or full perforations, scores, or cuts.

Unsealed area 30, formed between the top sheet 15 and the bottom sheet 25, is preferably located between tear slit 40 and blister 10. Preferably, a portion of either the top sheet or the bottom sheet is raised away from the other sheet to facilitate grasping the sheets after the tear is made through tear slit 40. A ridge may be placed in the raised area, e.g. between the blister and the tear slit, to guide the tear initiated at the tear slit away from the blister. Although unsealed area 30 may contact blister 10 or tear slit 40, a preferred blister package locates the unsealed area 30 away from both the blister 10 and tear slit 40 as shown in FIG. 1. Thus, the distance between the slit and the unsealed area affects the amount of force needed to propagate tear 50 towards unsealed area 30. Similarly, the distance between unsealed area 30 and blister 10 affects the amount of force needed to peel the bottom sheet and top sheet from one another.

As used herein, the term "unsealed area" also embraces an area of the package where a portion of either the top sheet or the bottom sheet is omitted. Thus, once the user tears the package at the slit and to the area where one sheet is absent, the remaining sheet is exposed so that the user can grasp it and peel it away from the corresponding sheet to expose the medication in the blister.

In an optional embodiment, the package may also have a channel extending partially or entirely between tear slit 40 and unsealed area 30. The channel guides the tear initiated at tear slit 40 in the desired direction toward unsealed area 30. The channel may be, for example, a fourth line of weakness.

Although the figures show the first, second, and third lines of weakness as lines of perforations, other mechanisms substantially equivalent to perforations may be used. For example, prefolded lines or scores may be used, or the lines of weakness may be formed by cuts made through or partially through either the top sheet or the bottom sheet. Similarly, any combination of prefolded lines, perforations, scores, or cuts may be used. For a line of weakness having perforations or scores, one may increase or decrease the ratio of cut area to the uncut area to adjust the force needed to tear or fold the package along that line of weakness. The location of the lines of weakness may be also varied to control the force and effort needed to open the package. For example, one may move the first and second lines of weakness further away from the package's edge to increase the force needed to isolate a single blister unit by tearing along the first and second lines of weakness.

The actual dimensions of the package may be varied by one of ordinary skill in the art to suit the particular end use desired. For example, the shape and size of the medication will determine the size of the blister. Thus, a typical blister may have a size of 28 mm×18 mm. The distance between the blister and the first or second perforation lines may be 1 to 18 mm, preferably 12 mm; the distance between the blister and the unsealed area may range from 2 to 6 mm, preferably 4 mm; the distance between the start of the first or second perforation lines and an edge may range from 2 to 8 mm, preferably 5 mm; the dimensions of the tear slit may range from 1 to 20 mm, preferably broken into two segments of 5 and 2 mm; the distance between the tear slit and the first or second perforation lines may range from 1 to 3 mm, preferably 2 mm, the distance between the tear slit and the unsealed area may range from 0 to 5 mm, preferably 0 mm, and the distance between the third line of weakness and its parallel, first or second line of weakness may range from 2 to 6 mm, preferably 4 mm.

Figure 2:
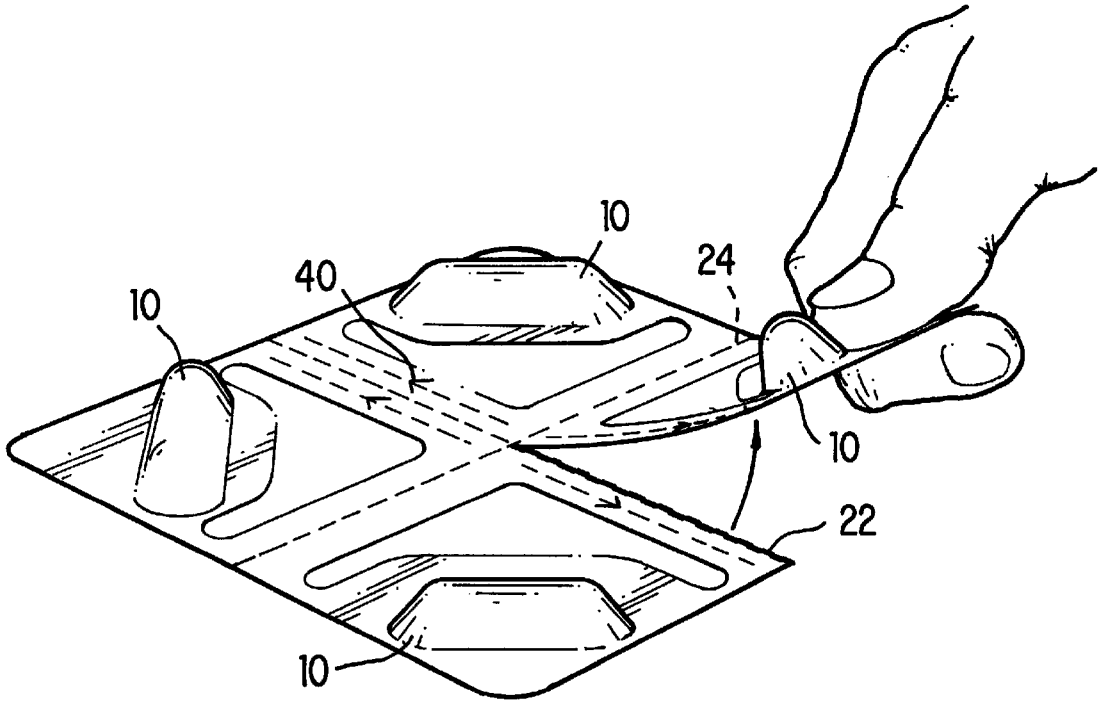
FIG. 2 shows a blister unit being separated by tearing along a first line of weakness.

FIGS. 2 through 6 depict a preferred method of dispensing medication from a package described herein. FIG. 2 shows a blister package having four blisters arranged substantially in rows, with first line of weakness 22 and second line of weakness 24 running between the rows and from one edge of the blister package to the opposite edge. The user first tears first line of weakness 22 and then tears second line of weakness 24 to separate a single blister unit from the blister package.

FIG. 3 shows a separated blister unit. As shown in FIG. 3, the user then folds the package along third line of weakness 26 to form a folded edge along the third line of weakness. Tear slit 40 is then exposed at the folded edge. As shown in FIG. 4, the user then initiates a tear 50 at exposed tear slit 40 in a direction running toward and continuing to unsealed area 30. As also shown in FIG. 4, tear 50 is initiated at a point located away from and not contacting unsealed area 30. Because of the folded edge along third line of weakness 26, tear 50 initially propagates through a double layer of packaging material, i.e. two layers of the top sheet 15 and two layers of the bottom sheet 25.

Figure 5:
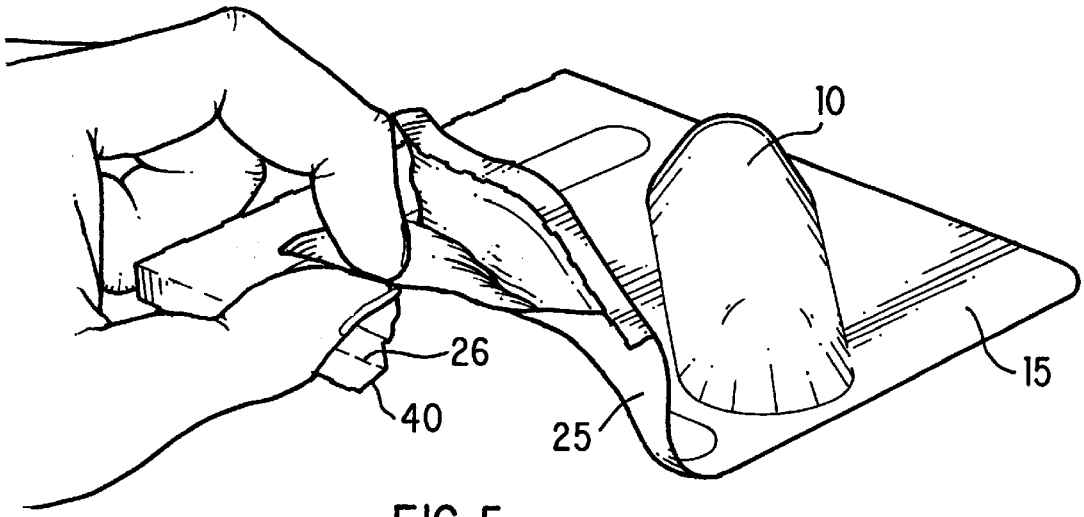
FIG. 5 shows the step of separating the bottom sheet away from the blister sheet at the unsealed area of the package.
Figure 6:
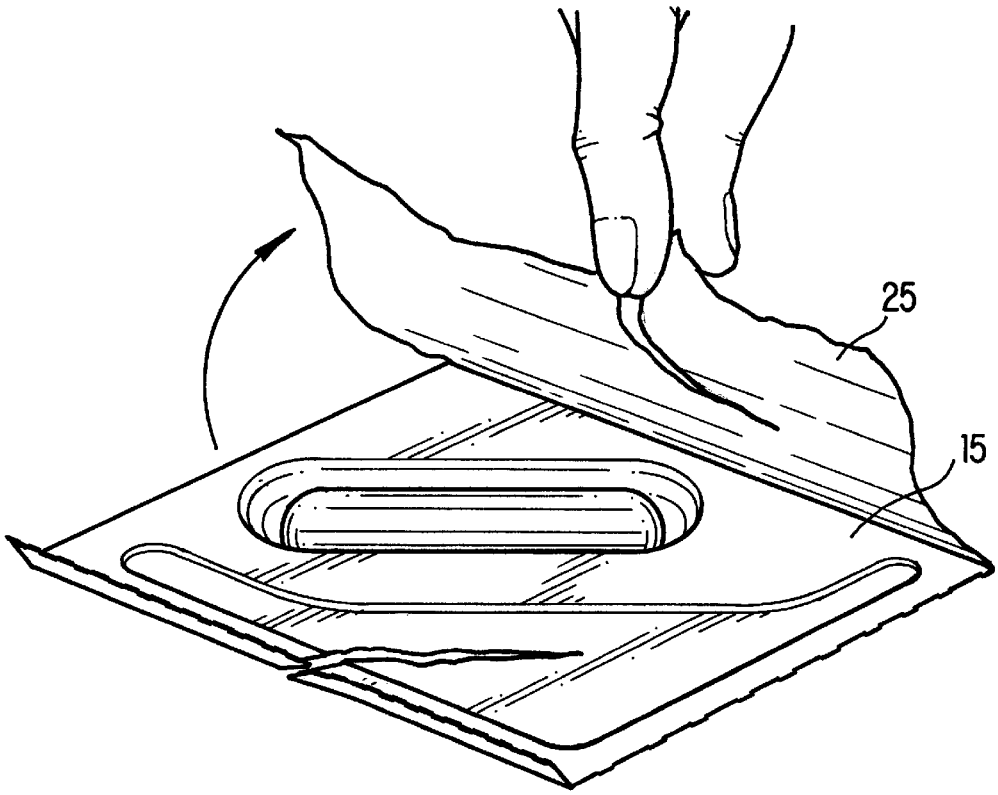
FIG. 6 shows the step of peeling the bottom sheet away from the top sheet to expose the contents of the package.

Once the user tears the package through the unsealed area 30, bottom sheet 25 and top sheet 15 are then exposed in an unsealed state where the user can grasp them. The user then peels the bottom sheet 25 and the top sheet 15 away from one another as shown in FIGS. 5 and 6. Preferably, the user will turn the blister package so that the medication remains in the recess formed by blister 10 before peeling the bottom sheet 25 and top sheet 15 from one another. The medication may then be administered at the proper dosage for its intended use.

The package may optionally include a third, "push through" sheet sandwiched between the top sheet and the bottom sheet. In this embodiment, after the tear is initiated at tear slit 40 and is propagated to the unsealed area, the bottom sheet is peeled away from the top sheet and the third sheet so that, after peeling, the medication remains inaccessible. The user must then push the medication through the third sheet after the lidding sheet is peeled away. In an alternative embodiment, the push through sheet is formed by a multilayer bottom sheet constructed so that, upon peeling, one or more of the layers remain behind. In such an embodiment, the medication may then be pushed through any layers of the bottom sheet that remain in place after peeling. In any case, the construction of the third sheet and the bottom sheet should not allow the medication to be pushed through the two sheets and accessed. Thus, the third sheet builds an additional step into the opening sequence.

The package may be constructed out of any materials typically used to produce conventional blister packages. For example, the top sheet, the bottom sheet, and/or the third, "push-through" sheet may be constructed of materials such as acrylonitrile (e.g. Klockner PENTAPHARM® PH 8B7/08), polyethylene terephthalate (e.g. Klockner PENTAPHARM® PH 8G1), polypropylene (e.g. Klockner PENTAPHARM® PH 885/76), polyvinyl chloride (e.g. VPI MIRREX® 1025), plastic multilayer structures (e.g. Klockner PENTAPHARM® A 200/02 and TECHNI-PLEX VDC®250-25-90), aluminum based multilayer structures such as polyamide/aluminum foil/polyvinyl chloride (e.g. Lawson MARDON® 15126), or paper based multilayer structures.

Preferably, the top sheet is a blister sheet constructed of Lawson MARDON® 90256 polyvinyl chloride/polyamide/aluminum foil/polyvinyl chloride and has a weight ranging from 320 g/m$^2$ to 400 g/m$^2$, more preferably 360 g/m$^2$. The bottom sheet is preferably constructed of Reynolds SAFETY-PAK® 204 paper/polyester/aluminum foil/polyvinyl chloride having a weight of about 77 to about 95 pounds per ream, more preferably about 86 pounds per ream.

The sheets used to form the package may be sealed together by heat sealing or with adhesives, or any combination thereof. All seals should be secure to prevent access to the medication without performing the previously described steps. Preferably, the top sheet and bottom sheet are heat sealed together by any means known and conventionally used in the art.

Other embodiments of the present invention will be apparent to those skilled in the art from consideration of the specification and practice of the invention disclosed herein. It is intended that the specification and figures be considered as exemplary only, with a true scope and spirit of the invention being indicated by the following claims.

I claim:

1. A package comprising:

(a) a top sheet having a surface that projects from one face of the top sheet and forms a plurality of recesses in the opposite face of the top sheet, (b) a bottom sheet overlying said opposite face of the top sheet, arranged to enclose each recess, wherein the recesses are arranged to form rows, (c) a sealed portion and an unsealed portion formed between the top sheet and the bottom sheet, wherein the unsealed portion is different from each recess, wherein each recess is associated with a sealed portion and an unsealed portion, and (d) a tear slit, which facilitates a tear to the unsealed portion, is located between the unsealed portion and an edge of the package, wherein the tear slit does not contact any edge of the package or the unsealed portion.

2. The package according to claim 1 wherein the tear slit is shaped to form an angle.

3. The package according to claim 1 wherein the first and second lines of weakness are perforated.

4. The package according to claim 1 wherein the recesses are arranged in rows.

5. A package comprising:

(a) a top sheet having a surface that projects from one face of the top sheet and forms a recess in the opposite face of the top sheet, (b) a bottom sheet overlying said opposite face of the top sheet, arranged to enclose the recess, (c) a sealed portion and an unsealed portion formed between the top sheet and the bottom sheet, wherein the unsealed portion is different from the recess, wherein the recess is associated with a sealed portion and an unsealed portion, and (d) a tear slit, which facilitates a tear to the unsealed portion, is located between the unsealed portion and an edge of the package, wherein the tear slit does not contact any edge of the package or the unsealed portion.

6. The package according to claim 5 wherein the tear slit is shaped to form an angle.

* * * * *